US009016984B1

(12) United States Patent
DeShazer

(10) Patent No.: US 9,016,984 B1
(45) Date of Patent: Apr. 28, 2015

(54) UNDERPINNING PILE ASSEMBLY ADAPTED FOR LOW FRICTION INSTALLATION

(71) Applicant: Henry Lee DeShazer, Houston, TX (US)

(72) Inventor: Henry Lee DeShazer, Houston, TX (US)

(73) Assignee: Patents of Tomball, LLC, Houston, TX (US)

( * ) Notice: Subject to any disclaimer, the term of this patent is extended or adjusted under 35 U.S.C. 154(b) by 0 days.

(21) Appl. No.: 13/856,110

(22) Filed: Apr. 3, 2013

(51) Int. Cl.
*E02D 5/28* (2006.01)
*E02D 7/02* (2006.01)

(52) U.S. Cl.
CPC . *E02D 5/285* (2013.01); *E02D 7/02* (2013.01)

(58) Field of Classification Search
CPC ..... E02D 5/52; E02D 5/523; E02D 5/526; E02D 5/285; E02D 2200/115; E02D 2600/20; E02D 7/02
USPC ..... 405/229, 230, 231, 232, 244, 251
See application file for complete search history.

(56) References Cited

U.S. PATENT DOCUMENTS

| | | | | |
|---|---|---|---|---|
| 3,975,917 | A * | 8/1976 | Asayama | 405/232 |
| 6,179,526 | B1 * | 1/2001 | Knight et al. | 405/232 |
| 6,468,003 | B2 * | 10/2002 | Merjan et al. | 405/253 |
| 6,536,993 | B2 * | 3/2003 | Strong et al. | 405/228 |
| 6,675,919 | B2 * | 1/2004 | Mosing et al. | 175/402 |
| 8,113,744 | B2 * | 2/2012 | Dimitrijevic | 405/252 |
| 8,500,368 | B1 * | 8/2013 | Deshazer et al. | 405/230 |

* cited by examiner

*Primary Examiner* — Thomas B Will
*Assistant Examiner* — Katherine Chu
(74) *Attorney, Agent, or Firm* — Egbert Law Offices, PLLC

(57) ABSTRACT

An underpinning pile assembly has a first pile with an inner diameter and an outer diameter, a second pile having a first portion and a second portion in which the first portion has an outer diameter less than an outer diameter of the second portion, and a ring affixed around the first portion of the second steel pipe. The ring has an outer diameter greater than the outer diameter of the second portion of the second steel pipe. The ring is releasably positioned over the first portion of the second steel pipe. A cable is affixed within an interior of the first steel pipe so as to extend through the interior of the second steel pipe. A plurality of additional steel pipes can be arranged in stacked relation upon an end of the second steel pipe opposite the first steel pipe.

8 Claims, 2 Drawing Sheets

UNDERPINNING PILE ASSEMBLY ADAPTED FOR LOW FRICTION INSTALLATION

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to underpinning pile assemblies. More particularly, the present invention the relates to underpinning pile assemblies in which friction on the exterior surface of the underpinning piles is reduced during the installation process. Additionally, the present invention relates to underpinning pile assemblies formed of a plurality of steel pipes arranged in stacked relation.

2. Description of Related Art Including Information Disclosed Under 37 CFR 1.97 and 37 CFR 1.98.

Many structures, such as residential homes and low-rise buildings, are constructed on foundations that are not in direct contact with a stable load-bearing underground stratum. These foundations are typically concrete slabs upon which a foundation wall rests. The footing is generally wider than the foundation wall in order to distribute the structure's weight over a greater surface area of load-bearing earth. As a result, the stability of the structure depends upon the stability of the earth below the foundation. Over time, the stability of the underlying soil may change for many reasons. When the stability of the support earth changes, the foundation may move or settle. This settling of the foundation can cause structural damage to the structure upon the foundation.

One common device and method to correct foundation settling is the employing of hydraulic jacks in conjunction with piers so as to lift the foundation. Piers, also known as piles or pilings, are driven into the ground by hydraulic mechanisms until the pier reaches bedrock or until the pier's frictional resistance equals the compression weight of the structure. Once the piers are secured in a stable underground stratum or several stable underground strata, further lifting by the hydraulic jacks raises the level of the foundation. When the foundation is raised to the desired level, the piers are permanently secured to the foundation. The hydraulic jacks are then removed.

Steel piers are well known and exist in many varieties. One common type of a pier is a straight steel pier that is driven down until it reaches bedrock or stable soil weight-bearing layers. These straight steel piers are rammed straight down into the ground.

During the installation of such steel piers in heavy clay soil, there is strong frictional contact between the heavy clay soils and the exterior surface of the steel pipes that are used for such steel piers. Eventually, the frictional force which contacts the exterior surface of these steel pipes becomes so great that further and deeper installation becomes difficult or impossible. Additional hydraulic power may be necessary so as to install such steel piers to the desired depth. Additionally, the ballast that is used so as to counteract the force of the hydraulic jack may be insufficient to achieve the forces necessary so as to effectively install the steel piers. Under such circumstances, the steel piers may not reach their desired depth. Additionally, this strong friction between the exterior surface of the steel pipe can significantly increase the amount of time devoted to the installation procedure. As such, a need has developed whereby the steel piers can be installed by reducing the friction force between the heavy clay soils and the exterior surface of the steel piers.

During the installation of such steel piers, it is desirable to power wash through the interior of the steel pipe. This power washing includes injecting water under great pressures through the interior of the steel pipes so that water is released at the bottom of the pier assembly. This will cause any soils below the end of the driving segment of the steel piers to fluidize such that the driven pier can move easily through the soil. Additionally, materials beneath the steel piers can be effectively removed through this power washing procedure. As such, a need has developed so as to create a low friction installation of such steel piers while, at the same time, maintaining the benefits of such power washing procedures.

In the past, a variety of patents have issued relating to the installation of such piles or piers. For example, U.S. Pat. No. 4,673,315, issued on Jun. 16, 1987 to Shaw et al., describes an apparatus for raising and supporting a building. The lifting assembly is inserted underneath the foundation or slab and is adapted to receive a pipe assembly. A clamping assembly is provided for engaging a portion of the pipe assembly extending above the lifting assembly. A hydraulic system extends between the lifting assembly and the clamping assembly for sequentially lowering the pipe assembly into the earth such that, when it encounters resistance, the foundation or slab is supported and can be raised to a predetermined level.

U.S. Pat. No. 4,678,373, issued on Jul. 7, 1987 to Langenbach, Jr., discloses an apparatus for shoring a structure. This apparatus includes a support bracket engageable with the foundation, a pile adapted to be driven down into the ground adjacent the bracket, and at least one footing structure on the outside of the pile extending circumferentially of the pile in a plane generally at right angles to the central longitudinal axis of the pile. The footing structure has an outer diameter greater than the outer diameter of the pile for engagement with the soil as the pile is driven down so as to increase the load-bearing capacity of the pile.

U.S. Pat. No. 5,336,021, issued on Aug. 9, 1994 to P. R. Freeman, III, shows a system for underpinning a building. A pier driving assembly is disclosed which supports the foundation under compression forces. The pier driving assembly includes a pier driving bracket which drives the pier pipes into the ground, a pier head which is placed on the pier pipe after the pipe has been driven to bedrock and the pier driving bracket assembly has been removed, and a loading bracket which gives the final lift to the foundation to make it level.

U.S. Pat. No. 6,179,526, issued on Jan. 30, 2001 to Knight et al., provides a method for forming a pile isolation void which includes forming a foundation pile having an enlarged cross-section within a specific localized section and driving the foundation pile a desired distance into the earth so as to form a pile isolation void directly above the enlarged cross-section. The enlarged cross-section can be located at the bottom of the foundation pile or along the length of the foundation pile. The pile isolation void is an annular void extending around the foundation pile above the enlarged cross-section. This pile isolation void can be filled with a material, such as liquid, gel, or a solid material different than the material of the pile or of the earth. The enlarged cross-section can be a collar placed upon the foundation pile, or integrally formed with the foundation pile.

U.S. Pat. No. 7,044,686, issued on May 16, 2006 to D. May, provides an apparatus and method for supporting a structure with a pier. The pier assembly is provided with a rotatable shelf so as to secure a screw jack assembly under a footing of a foundation.

U.S. Pat. No. 7,195,426, issued on Mar. 27, 2007 to D. May, teaches a structural pier and method for installing the structural pier. The pier includes a pier shaft, a bracket mounted to a top end of the pier shaft that supports the weight of the foundation, and a pair of braces that extend laterally from the pier shaft and mount to the foundation.

U.S. Pat. No. 7,857,549, issued on Dec. 28, 2010 to the present inventor, discloses an underpinning pile assembly for supporting a structure upon the earth. This underpinning pile assembly has at least one steel pipe, at least one concrete pile segment positioned above the steel pipe, and a transition member interposed between the steel pipe and the concrete pile such that the load of the concrete pile is supported by the steel pipe. The steel pipe includes a plurality of steel pipe segments extending in end-to-end relationship in generally vertical alignment. A key member is received in slots formed in the respective ends of the first and second segments. The plurality of concrete pile segments includes a strand affixed in holes formed through the plurality of concrete pile segments.

U.S. Pat. No. 8,272,810, issued on Sep. 25, 2012 to Dimitrijevic et al., shows pilings for foundation underpinning. A pile segment includes a head, a trunk extending from the head, and a throughbore passing axially through the head and the trunk. The throughbore has a longitudinal centerline. The area of a cross-section through the head and normal to the centerline is greater than the area of a cross-section through the trunk and normal to the centerline.

It is an object of the present invention to provide an underpinning pile assembly which serves to reduce friction between the surfaces of the underpinning pile assembly and the earth during the driving of the pile.

It is another object of the present invention to provide an underpinning pile assembly which facilitates the ability to drive pile in heavy clay soils.

It is still another object of the present invention to provide an underpinning pile assembly that offers better penetration when there is a lack of sufficient ballast.

It is still another object of the present invention to provide an underpinning pile assembly which facilitates the use of power washing through the interior of the steel pipe of the underpinning pile assembly.

It is still a further object of the present invention to provide an underpinning pile assembly that can be easily assembled at the word site.

It is still a further object of the present invention to provide an underpinning pile assembly which reduce the time required for the installation of the underpinning pile assembly.

It is a further object of the present invention to provide an underpinning pile assembly which minimizes the amount of hydraulic force required to reach the desired depth.

It is still another object of the present invention to provide an underpinning pile assembly which reduces the amount of time required to install the pile assembly.

These and other objects and advantages of the present invention will become apparent from a reading of the attached specification and appended claims.

BRIEF SUMMARY OF THE INVENTION

The present invention is an underpinning pile assembly that comprises a first pile having an outer diameter and a longitudinal axis, a second pile having an outer diameter and a longitudinal axis, and a ring interposed between the first pile and the second pile. The longitudinal axis of the first pile is generally aligned with the longitudinal axis of the second pile. The ring has an outer diameter greater than the outer diameter of the second pile.

In the underpinning pile assembly of the present invention, each of the first and second piles is a steel pipe. The ring has an inner diameter greater than an inner diameter of the first pile. The inner diameter of the ring is less than an outer diameter of the first pile.

The first pile has an opening at an upper and thereof. The second pile has a reduced diameter section at a lower end thereof. The reduced diameter section is received in the opening at the upper end of the first pile. The ring extends around the reduced diameter section. The second pile has a shoulder at the reduced diameter section. The ring is, in particular, interposed between the upper end of the first pile and the shoulder of second pile. The ring is removably affixed over this reduced diameter section. The outer diameter of the first pile is identical to the outer diameter of the second pile.

A cable has one end affixed to the first pile. The cable extends from the first pile to an interior of the ring and through an interior of the second pile. The cable has an end extending outwardly of the second pile. A plurality of additional pile segments are arranged in stacked relation upon an end of the second pile opposite the first pile. Each of the plurality of additional pile segments has an outer diameter equal to an outer diameter of the second pile. The ring has an outer diameter less than one inch greater than the outer diameter of the second pile. The ring has an inner diameter slightly greater than an outer diameter of the reduced diameter section of the second pile.

The present invention is also a method of forming an undermining assembly which comprises the steps of: (1) affixing a cable to an interior of a first pile such that the cable extends outwardly of an end of the first pile; (2) forming a second pile having a first portion with an outer diameter that is less than an outer diameter of the second portion; (3) placing a ring over the first portion of the second pile such that the ring has an outer diameter greater than the outer diameter of the second portion of the second pile; (4) threading the cable through an interior of the second pile; (5) moving the second pile along the cable toward the first pile; and (6) inserting the first portion of the second pile into the opening of the first pile such that the ring bears against the end of the first pile. The first pile and the second pile are driven into the earth such that the ring forms an opening in the earth greater than the outer diameter of the second portion of the second pile.

The foregoing Section is intended to describe, in generality, the preferred embodiment of the present invention. It is understood that modifications to this preferred embodiment can be made within the scope of the present invention. As such, this Section should not be construed, in any way, as limiting of the broad scope of the present invention. The present invention should only be limited by the following claims and their legal equivalents.

DETAILED DESCRIPTION OF THE INVENTION

Figure 1:
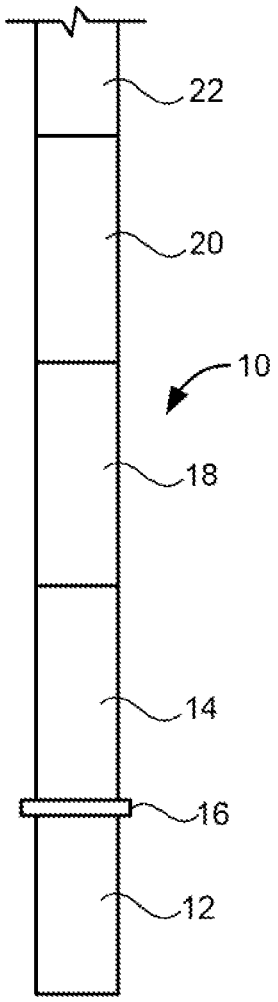
FIG. 1 is a side elevational view showing the underpinning pile assembly of the present invention.

Referring to FIG. 1, there is shown the underpinning pile assembly 10 in accordance with the preferred embodiment of the present invention. The underpinning pile assembly 10 includes a first pile 12, a second pile 14 and a ring 16 interposed between the first pile 12 and the second pile 14. A plurality of additional pile segments 18, 20 and 22 are arranged in stacked relationship upon the end of the second pile 14 opposite the first pile 12.

In FIG. 1, it can be seen that the first pile 12 is the starter pile. In other words, the first pile 12 is driven into the earth as the lead for the underpinning pile assembly. The second pile 14 rests in end-to-end relationship upon the upper end of the first pile 12. The second pile 14 will have an outer diameter approximately equal to the outer diameter of the first pile 12. Each of the piles 12 and 14 will have a generally cylindrical configuration. In the preferred embodiment of the present invention, each of the piles 12, 14, 18, 20 and 22 will be steel pipes.

The ring 16 is illustrated as having an outer diameter slightly greater than the outer diameters of the first pile 12 and the second pile 14. The ring 16 will be interposed between the first pile 12 and the second pile 14. The ring 16 is located adjacent to the lower end of the underpinning pile assembly 10 so as to carry out its intended purpose.

In operation, the underpinning piles 12, 14, 18, 20 and 22 are driven into the earth for a desired distance. As these piles are being driven into the earth, the large diameter of ring 16 generally penetrates the earth so as to create a void slightly greater than the outer diameters of the pile 14, 16, 18, 20 and 22. As such, the ring 16 will cut through the earth so as to facilitate the low-friction passage of the remaining piles through the earth. Ultimately, experiments of the present invention have found that the thixotropic action of the earth will cause the earth to swell around the outer diameters of the pile segments after installation. As such, the earth will securely retain the pile segments 12, 14, 16, 18 and 20 in position. As a result, the present invention is able to establish low-friction installation while, at the same time, maintaining the stability of the ultimate assembled pile assembly. It has been found that this thixotropic action will be complete seventy-two to ninety-six hours after installation.

Figure 2:
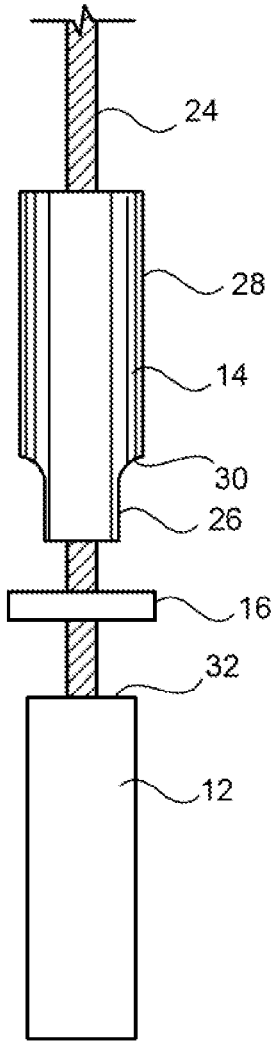
FIG. 2 is a side elevational view of a disassembly of the underpinning pile assembly of the present invention.

FIG. 2 illustrates the assembly of the second pile 14 to the first pile 12 and to the ring 16. Initially, it can be seen that there is a cable 24 that has an end affixed within the interior of the first pile 12. The cable 24 will extend through the first pile 12, through the interior of the ring 16, and through the interior of the second pile 14.

The second pile 14 is illustrated as having a first portion 26 and a second portion 28. A shoulder 30 is formed in the area between the first portion 26 and the second portion 28. The first portion 26 will have a smaller outer diameter than the diameter of the second portion 28. As such, during installation, the first portion 26 can be inserted into the open upper end 32 of the first pile 12. During the insertion, the interior diameter of ring 16 will overlie the outer diameter of the first portion 26 and ultimately bear against the shoulder 30. The outer diameter of the second portion 28 of the second pile 14 is generally equal to the outer diameter of the first pile 12. In this configuration, the ring 16 will be interposed between the shoulder 30 of the second pile 14 and the end 32 of the first pile 12. As such, the ring 16 will have an outer diameter which is greater than the inner diameter of the first pile 12 and an inner diameter which is greater than the inner diameter of the first pile 12.

Figure 3:
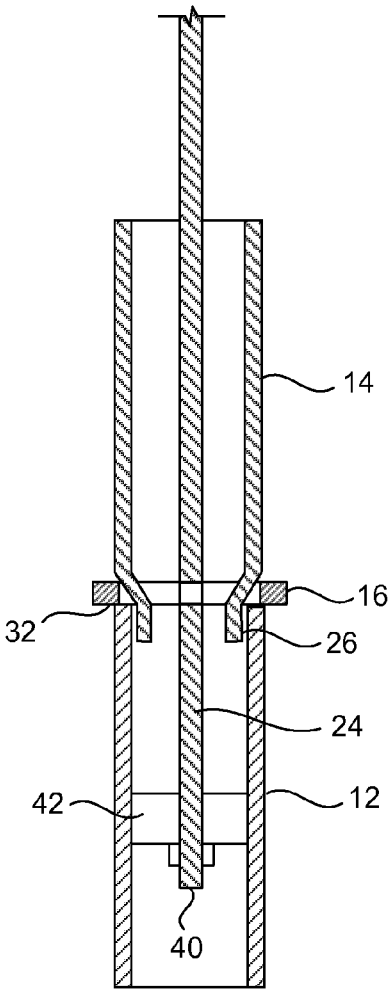
FIG. 3 is cross-sectional view of the underpinning pile assembly of the present invention.
Figure 4:
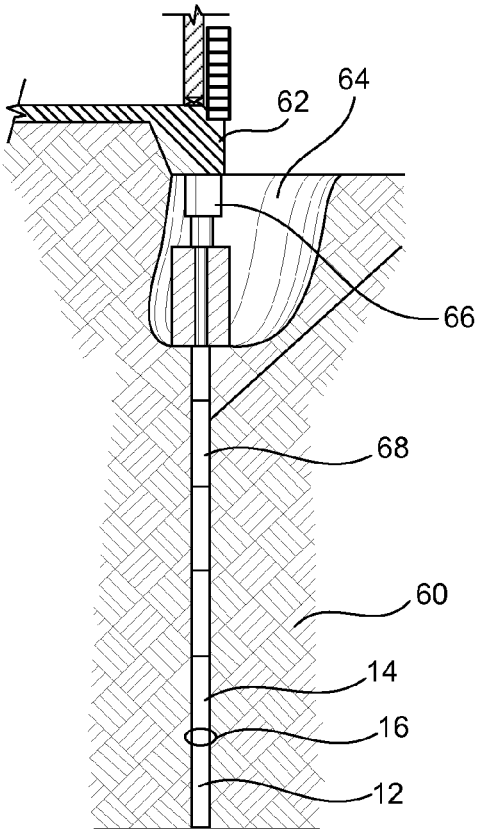
FIG. 4 is a plan view of the ring as used in the underpinning pile assembly of the present invention.

FIG. 3 illustrates the manner in which the ring 16 is received between the first pile 12 and the second pile 14. In particular, in FIG. 3, it can be seen that the cable 24 has its end 40 that is affixed to a structure 42 within the interior of the first pile 12. The first portion 26 of the second pile 14 has an outer diameter which is less than the inner diameter of the first pile 12. As such, the first portion 26 can be inserted easily into the interior diameter of the first pile 12. The ring 16 will overlie this first portion 26 of the second pile 14 and will reside against the end 32 of the first pile 12. As can be seen in FIG. 3, the inner diameter of the ring 16 is greater than the inner diameter of the pile 12 and the outer diameter of the ring 16 is greater than the outer diameters of the first pile 12 and the second pile 14. The cable 24 extends through the interior of the second pile 14 so as to extend upwardly therefrom. As such, the remaining pile segments 18, 20 and 22 can be threaded over the cable 24 so as to complete the installation process.

The ring 16 can be formed of a rigid carbon steel material. As such, it will not flex during the installation process. The edges of the ring 16 carry out a proper cutting action through the earth during installation. As such, this ring 16 facilitates the ability of the remaining pile sections to be installed within the earth and avoids the frictional contact between heavy clay soils and the exterior surface of the piles.

Importantly, so as to facilitate installation, the ring 16 should have a slight wiggling or wobbling effect. As such, the inner diameter of the ring 16 should be slightly greater than the outer diameter of the first portion 26 of the second pile 14. As such, this loose fit of the ring 16 will establish a proper sawing action as it moves through the earth. In the preferred embodiment of the present invention, the ring 16 has outer diameter which is no more than one inch greater than the outer diameter of the first pile 12 and/or the second pile 14. If the outer diameter of the ring 16 was too great, then it would create additional problems during the installation in the manner of hanging up within the soil. It would also prolong the thixotropic action of the surrounding soil. If the outer diameter of the ring 16 is too small, it will not enhance the reduction of friction during installation.

Figure 5:
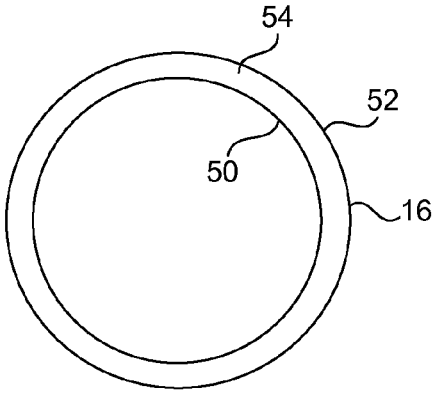
FIG. 5 is a diagrammatic illustration showing the installation of the underpinning pile assembly of the present invention.

FIG. 5 illustrates the configuration of the ring 16. The ring 16 has an annular configuration with an inner diameter 50 and an outer diameter 52. As was stated hereinbefore, the inner diameter should be slightly greater than the outer diameter of the first portion 26 of the second pile 14. The outer diameter 52 should be greater than the outer diameters of the first pile 12 and the second pile 14. The surface 54 of the ring 16 can bear against the shoulder 30 of the second pile 14. Additionally, the opposite side of the ring 16 can rest upon the end 32 of the first pile 12.

FIG. 5 illustrates the assembled arrangement of pile segments within the earth 60. As can be seen, there is a foundation 62 and an excavation 64. A hydraulic jack 66 is placed under the foundation 62 so as to urge the pile segments 68 into the earth. The ring 16 is illustrated as positioned between the first pile 12 and the second pile 14. During installation, the jack 66 will urge the pile segments 12 and 14 into the earth. The ring 16 will cut a small channel through the earth adjacent to the outer diameters of the pile segments 68. As this small annulus is created, the pile segments 68 will move through the heavy clay soils in a low friction manner so as to enhance the ability to properly introduce the desired number of pile segments 68 to the desired depth within the earth. After the desired depth is reached, suitable shoring structures can be placed underneath the foundation 62 so as to place the foundation 62 in its desired orientation. The excavation 68 can then be covered.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An underpinning pile assembly comprising:

a first pile having an outer diameter and a longitudinal axis and an inner diameter, said first pile having an upper end;

a second pile having a longitudinal axis, said longitudinal axis of said first pile being generally aligned with said longitudinal axis of said second pile, said second pile having a portion at a lower end thereof, said portion having an outer diameter that is less than an outer diameter of a remainder of said second pile above said portion, said portion being slidably received within said upper end of said first pile; and a ring interposed between said upper end of said first pile and a lower end of said remainder of said second pile, said ring having an outer diameter greater than said outer diameter of said first pile and greater than said outer diameter of said remainder of said second pile, said ring having an inner diameter less than said outer diameter of said first pile and less than said outer diameter of said remainder of said second pile, said ring having an inner diameter extending around said portion of said second pile and greater than said outer diameter of said portion.

2. The underpinning pile assembly of claim 1, each of said first and second piles being a steel pipe.

3. The underpinning pile assembly of claim 1, said ring having an inner diameter greater than an inner diameter of said first pile.

4. The underpinning pile assembly of claim 1, said second pile having a shoulder at said portion, said ring interposed between said upper end of said first pile and said shoulder of second pile.

5. The underpinning pile assembly of claim 1, said outer diameter of said first pile being identical to said outer diameter of said second pile.

6. The underpinning pile assembly of claim 1, further comprising;

a cable having an end affixed to said first pile, said cable extending from said first pile through an interior of said ring and through an interior of said second pile, said cable having an end extending outwardly of said second pile.

7. The underpinning pile assembly of claim 1, said outer diameter of said ring being less than one inch greater than said outer diameter of said second pile.

8. The underpinning pile assembly of claim 1, further comprising:

a plurality of additional piles arranged in stacked relation upon an end of said second pile opposite said first pile, each of said plurality of additional pile segments having an outer diameter equal to said outer diameter of said second pile.

* * * * *